US005460014A

United States Patent [19]

Wang

[11] Patent Number: 5,460,014

[45] Date of Patent: Oct. 24, 1995

[54] ICE MAKING MACHINE

[76] Inventor: Hsin-Tsai Wang, Suite 1, 11F, 95-8 Chang Ping Road, Sec. 1, Taichung, Taiwan

[21] Appl. No.: 239,938

[22] Filed: May 9, 1994

Related U.S. Application Data

[63] Continuation-in-part of Ser. No. 995,805, Dec. 15, 1992, abandoned.

[51] Int. Cl.[6] ..... F25C 5/12

[52] U.S. Cl. ..... 62/354

[58] Field of Search ..... 62/354; 165/94

[56] References Cited

U.S. PATENT DOCUMENTS

| | | | |
|---|---|---|---|
| 3,206,287 | 9/1965 | Crawford | 165/94 X |
| 3,410,335 | 11/1968 | Malmstrom et al. | 165/94 X |
| 4,075,868 | 2/1978 | Bartholmey | 62/354 X |
| 4,532,776 | 8/1985 | Arcangeli | 62/354 |
| 4,538,428 | 9/1985 | Wilkerson | 62/354 |

*Primary Examiner*—William E. Tapolcai

[57] ABSTRACT

An ice making machine comprises a vertically aligned, cylindrical cooling cylinder of hollow annular section, a motor driven auger disposed within the inner periphery of the cooling cylinder, and an external cooling system including a compressor and heat exchanger as in the conventional fashion. Water is pumped into a freezing cavity containing the auger that is defined between the inner periphery of the cooling cylinder and a concentric inner cylinder. The auger scrapes ice from the inner periphery of the cooling cylinder and forces the flakes upwards toward an ejector above the cooling cylinder. The improvement thereof comprises the inclusion of a second cooling cylinder wherein the first auger scrapes ice from the corresponding peripheries of both cylinders and the second auger scrapes in from the additional ice forming surface defined by the inner periphery of the second cylinder.

2 Claims, 4 Drawing Sheets

ICE MAKING MACHINE

This application is a continuation-in-part of application Ser. No. 07/995,805, filed on Dec. 15, 1992, now abandoned.

BACKGROUND OF THE PRESENT INVENTION

The present invention relates to an improved structure ice making machine, and more particularly to an ice making machine of the type having a cooling cylinder of annular section for forming ice on an inner periphery thereof which is scraped by an auger disposed therein, wherein the improvement is characterized in having an additional concentric cooling cylinder so as to provide additional ice forming surfaces and a second auger for scraping the inner periphery of the second cylinder.

More conventional ice makers of this generic type generally employ a single cooling cylinder, which is supplied with a compressed refrigerant from an external cooling system, and a single helical auger which scrapes ice from the inner peripheral surface thereof and moves the ice flakes upwards towards an ejector. The improved ice maker of the present invention with its plurality of ice making surfaces and augers thus can provide a unit of greater capacity and efficiency.

SUMMARY OF THE PRESENT INVENTION

An improved ice making machine in accordance with the present invention comprises an outer cooling cylinder of annular section, an inner cooling cylinder disposed concentrically within the outer cylinder, a first motor driven auger disposed therebetween, and a second auger disposed within the inner cylinder. As in more conventional ice making machines, a compressor and heat exchanger are provided for supplying refrigerant to the outer and inner cooling cylinders. The first auger scrapes ice from the corresponding peripheral walls of the outer and inner cylinders as does the second auger from the inner periphery of the inner cylinder, while moving the ice flakes towards an upper ejector for expulsion from the ice maker in compacted chunks. Alternately, ice in the form of a slurry possibly mixed with granular additives can be generated and expelled from a lower egress by interchanging some of the members in the freezing unit.

Thus it is a main object of the present invention to provide an ice making machine having a plurality of cylindrical ice forming surfaces therein so as to offer greater efficiency and ice making capacity relative to a conventional ice maker of comparable size.

DETAILED DESCRIPTION OF THE PREFERRED EMBODIMENT

Figure 1:
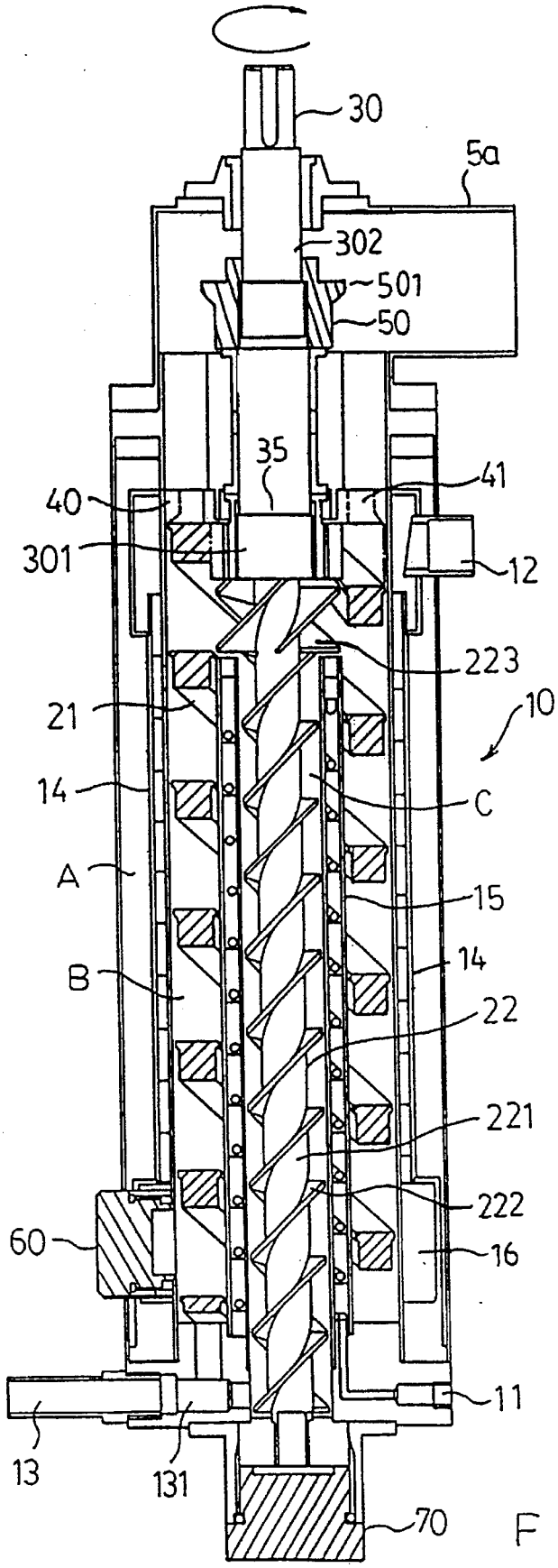
FIG. 1 is a sectional view of the ice making assembly of the present invention adapted for a first mode of operation.
Figure 3:
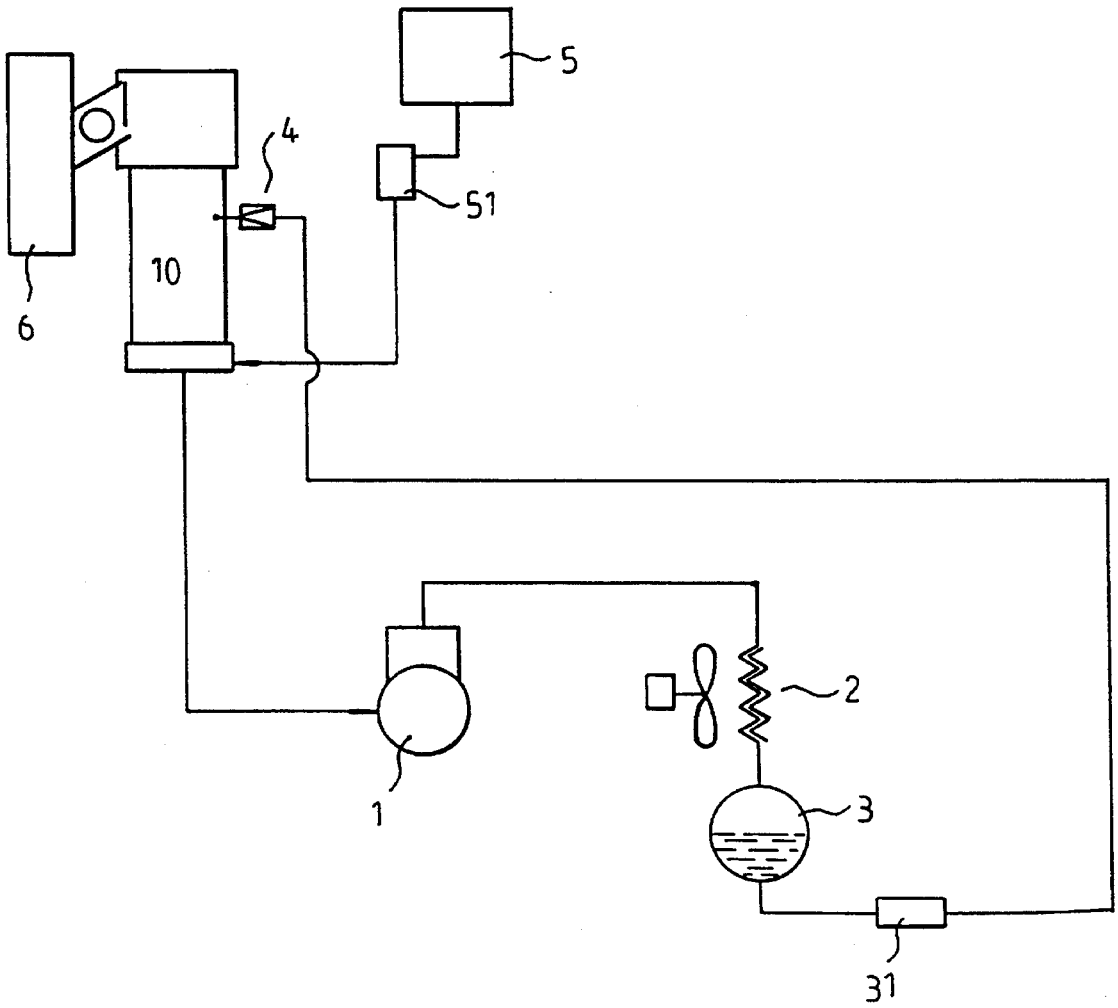
FIG. 3 is a schematic diagram of the refrigerating unit of the ice making machine.

Referring to FIGS. 1 and 3 of the drawings, the ice making machine of the present invention comprises a roughly cylindrical freezing unit 10 which is normally held in a vertical position, and a refrigerating system, shown schematically in FIG. 3, connected therewith.

The refrigerating system includes a compressor 1, a condenser 2, and a reservoir 3 and a dryer 31 which together send and receive a suitable, environmentally safe refrigerant to and from the freezing unit. The refrigerant enters the freezing unit 10 through a lower inlet 11 thereon via an external expansion valve 4 and returns to the compressor via an outlet 12 projecting from the upper periphery of the unit. A water supply 5 supplies the freezing unit with water through a lower ingress 13 via a control valve 51. The specification of the refrigerating system, which is similar with those employed in more conventional ice makers of this type, can be readily accomplished by a person of average skill in the related field and as such no further details related therewith will be brought forth herein.

Freezing unit 10, as shown in FIG. 1, is configured for a first operational mode wherein ice in chunk form is forced through an upper egress duct *5a* attached to an ejector 6 on the side of the freezing unit, as shown in FIG. 3. The ejector can be of a worm type, which has a rotating spiral pusher, as employed in more conventional ice makers. The freezing assembly contains a first cooling cylinder 14 of annular cross-section which is separated from the outer peripheral wall thereof by a space A which is filled with a suitable insulator. A second cooling cylinder 15 of annular section is disposed concentrically within the first cylinder. A first freezing chamber B is defined between the first and second cylinders 14,15. A helical auger 21 having one or more mutually spaced spiral blades is rotatingly positioned between the first and second cylinders wherein the outer peripheries of the blades circumscribe a cylindrical surface of slightly lesser diameter than the inner periphery of the outer cylinder 14, and the inner peripheries of the blades circumscribe a cylindrical surface of slightly greater diameter than the outer periphery of the inner cylinder 15. A second auger 22 having a shaft 221 and a helical blade 222 therearound is rotatingly positioned within the inner periphery of cylinder 15 with blade 222 and the periphery of the cylinder also being separated by a comparable space. The space between shaft 221 and the inner periphery of cylinder 15 defines a second freezing chamber C. Further, the inner periphery of cylinder 14 defines a first ice making surface while the outer and inner peripheries of cylinder 15 define a second and third ice making surface, respectively. Ingress 13 branches at 131 to supply water to the lower portions of respective cavities B and C.

Both cylinders 14 and 15 have hollow cavities for the passage of the refrigerant. As with conventional ice makers, the cooling cavities are provided with helical fins therein which define spiraling ducts for the flow of the refrigerant. The inlet 11 is connected to a coiled tube disposed within the cavity of cylinder 15 whereby the refrigerant exits the tube in the upper portion of the cylinder and flows downward through the spiraled duct towards the base of the cylinder assembly. There, a coupling plate 16 communicates the refrigerant to the outer cylinder 14. The refrigerant then flows upwards therein to exit through the upper outlet 12 and return to the compressor.

Figure 4:
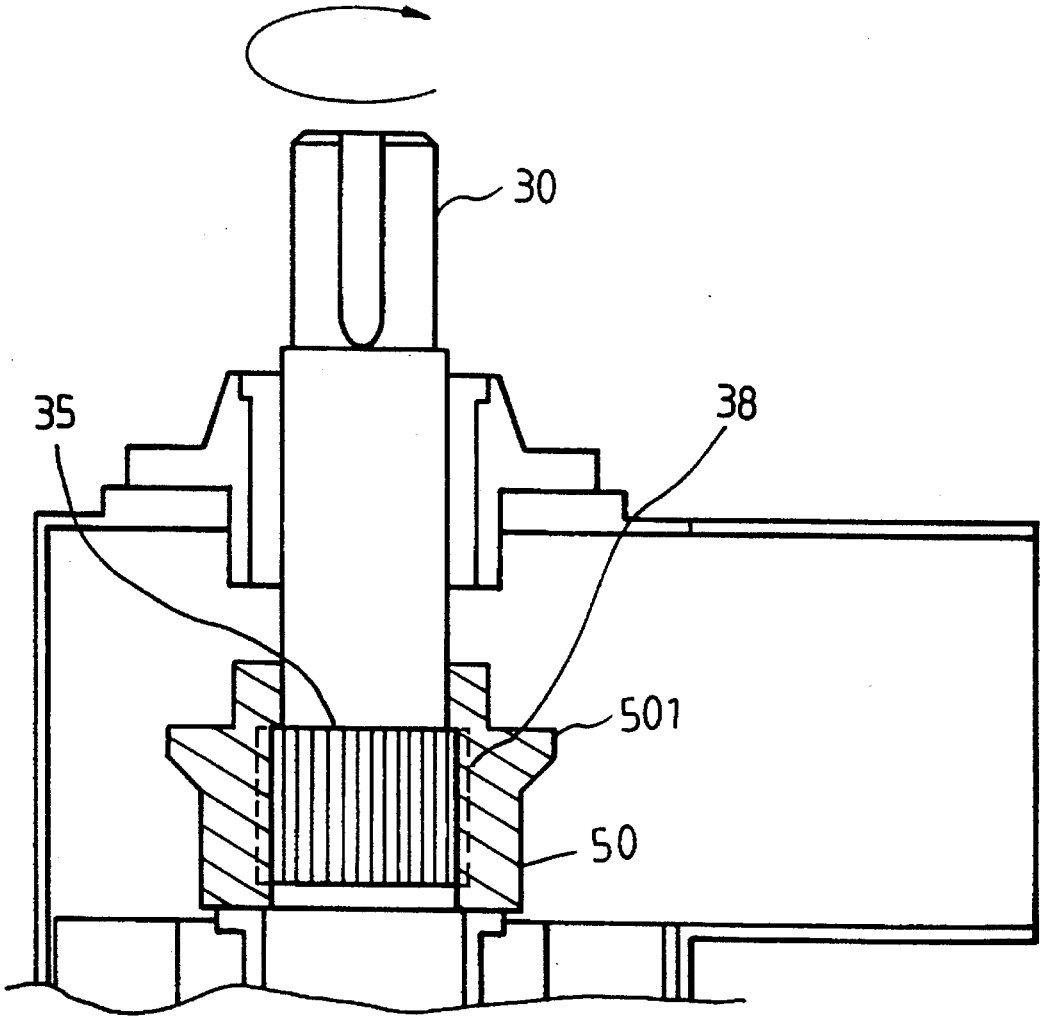
FIG. 4 is a schematic diagram of the upper portion of the ice making assembly of the present invention.

In operation, water intromited into cavities B and C freezes on the peripheral ice forming surfaces of cylinders 14,15. The augers 21 and 22 which are coupled to an externally rotated shaft 30 scrape the ice from the cylinder walls and move the ice flakes upwards in their respective cavities. Shaft 30 has a lower end portion 301 which receives and couples the upper end portion of auger 22, with the periphery of medial portion 302 being coupled to the inner periphery of the upper end portion of auger 21 via cooperating splines and keyed channels similar to the cooperating splines 35 and keyed channels 38 on the inner periphery of an annular breaker 50 thereon, as seen in FIG. 4. The blade 222 has an enlarged upper portion above the opening of cylinder 15 which mixes the outflow therefrom with the ice from chamber B. The largely frozen slurry is then forced upwards through an annular extruder plate 40 having a plurality of slots 41 or predetermined section formed thereon. The compacted ice from the extruder plate travels upward and impinges the annular breaker 50 thereabove having a radially projecting upper rim 501. The breaker 50 causes the ice to fracture into chunks of desired size which are removed by the action of the ejector via a ducted flange 5*a*. Ejector 6 then expels the ice in a downward direction towards a container for use.

Figure 2:
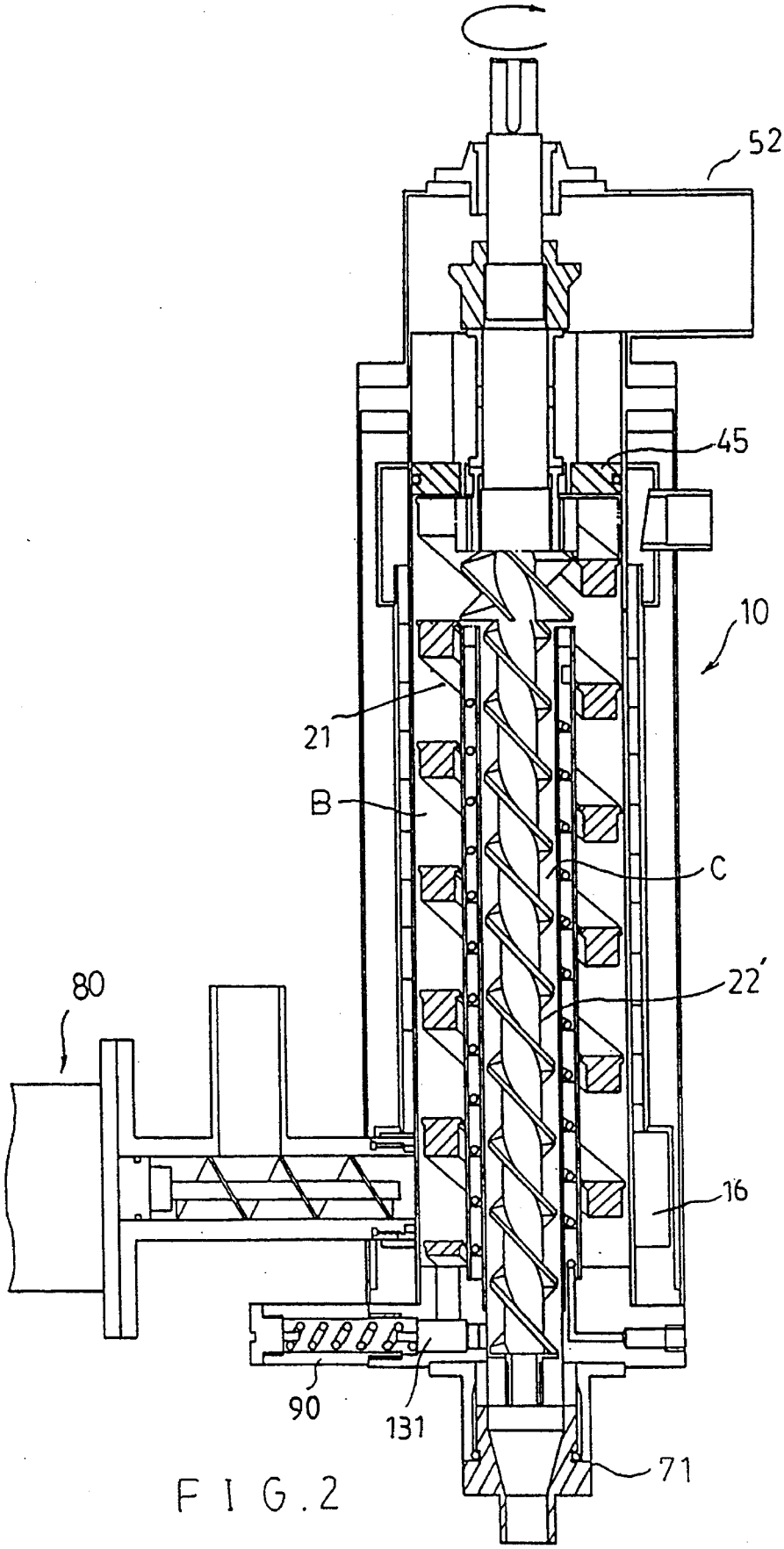
FIG. 2 is a sectional view of the ice making assembly of the present invention adapted for a second mode of operation.

The ice making machine can also be configured for a second mode of operation for making ice slurry form and which is particularly well suited for the admixture of flavorings or granular additives. Referring to FIG. 2, for this second mode of operation a number of members in the ice making assembly are interchanged. Firstly, the flanged duct 5*a* is removed so that the shaft 30 and augers 21,22 are accessible. The shaft 30 and attached augers 21,22 are then extracted and the inner auger 22 replaced with an auger 22' having a helical blade of opposite twist. The extruder plate 40 is also replaced with an annular obturator 45 prior to the reassembly of the augers and duct. In this arrangement, ice formed within cavities B and C are moved in opposite directions by the respective augers 21 and 22' wherein upwardly moving ice from chamber B is redirected by obturator 45 so as to enter chamber C which forces ice therein downward A plug 70, shown in FIG. 1, which closes the lower end of chamber C is removed and replaced with a nozzle 71 so that ice can be ejected therefrom. Additionally, inlet 13 is replaced with a valve member 90 which obturates the former ingress to the inner chamber C at 131, but which maintains communication with cavity B. The valve member acts as a safety release should excessive pressure build up in the chamber. Water now enters chamber B via a larger auxiliary inlet above member 90 which was closed by a cover 60 in the prior mode. Optionally, a feeder 80 can be attached to the auxiliary inlet to facilitate the mixing of granular additives such as fruit pulp or flavorings.

Note that in this operational mode an ice mixture travels through both chambers before exiting the assembly and hence is cooled to a lower temperature relative to a mixture processed by using the first mode. This suits the intended usage as ice mixtures having considerable quantities of dissolved substances or other additives have lower freezing temperatures.

Though many specificities were brought forth in the above description, these should not be construed in a limitative sense but rather as being exemplary of a preferred embodiment thereof, with the actual spirit and scope of the present invention being determined instead from the appended claims and their legal equivalents.

I claim:

1. An improved ice making machine comprising:

an outer cooling cylinder of hollow annular section and an inner cooling cylinder of hollow annular section disposed concentrically within the bore of said outer cooling cylinder, said outer cooling cylinder and said inner cooling cylinder defining an outer ice making chamber therebetween with an inner periphery of said outer cooling cylinder defining a first freezing surface and an outer periphery of said inner cooling cylinder defining a second freezing surface, and the bore of said inner cooling cylinder defining an inner ice making chamber therein with an inner periphery of said inner cooling cylinder defining a third freezing surface;

an outer helical auger having at least one blade disposed within said outer ice making chamber, an outer periphery of each said at least one blade of said outer helical auger being substantially spaced from said first freezing surface, an inner periphery of each said at least one blade of said outer helical auger being substantially spaced from said second freezing surface;

an inner helical auger having at least one blade disposed within said inner ice making chamber, an outer periphery of each said at least one blade of inner helical auger being substantially spaced from said third freezing surface;

an externally rotated shaft fixedly coupled with said outer helical auger and said inner helical auger so as to rotate therewith;

a water ingress for intromitting a water mixture into said outer ice making chamber proximate a first end thereof;

a conduit between the first end of said outer ice making chamber and an associated first end of said inner ice making chamber for the passage of the water mixture;

a mixing chamber disposed adjacent associated second ends of said outer ice making chamber and said inner ice making chamber, said mixing chamber being in communication therewith;

an ice egress in communication with said mixing chamber;

a cooling system for circulating a refrigerant through said outer cooling cylinder and said inner cooling cylinder;

whereby, ice formed in said inner ice making chamber and said outer ice making chamber is displaced by respective said inner helical auger and said outer auger towards said mixing chamber and expelled through said ice egress.

2. An improved ice making machine according to claim 1, wherein said inner helical auger is releasably coupled to said shaft, and said improved ice making machine further comprises;

an obturable, second ice egress disposed adjacent the first end of said inner ice making chamber in communication therewith;

an obturater plate positionable between said mixing chamber and said ice egress;

a valve means disposable in said conduit for shutting off the flow of water therethrough;

a second inner helical auger interchangeable with said inner helical auger, said second inner helical auger having an opposing helical twist with respect to that of said inner helical auger;

whereby, with said second inner helical auger disposed in said inner ice making chamber, said obturater plate disposed between said mixing chamber and said ice egress, said valve means disposed in said conduit, and said second ice egress in an open position, a water mixture and ice in said outer ice making chamber is displaced into said mixing chamber, then displaced through said inner ice making chamber, and expelled through said second ice egress.

* * * * *